United States Patent [19]

Soffer et al.

[11] Patent Number: 4,686,647

[45] Date of Patent: Aug. 11, 1987

[54] NUMERICAL DIVISION OF TWO ARRAYS BY OPTICAL PROCESSING

[75] Inventors: Bernard H. Soffer, Pacific Palisades; Uzi Efron, West Los Angeles; Emanuel Marom, Beverly Hills, all of Calif.

[73] Assignee: Hughes Aircraft Company, Los Angeles, Calif.

[21] Appl. No.: 645,573

[22] Filed: Aug. 29, 1984

[51] Int. Cl.[4] ..... G06G 9/00

[52] U.S. Cl. ..... 364/850; 364/606; 364/807

[58] Field of Search ..... 364/800, 807, 850, 606, 364/713, 761–767; 350/96.11, 96.12, 96.16, 162.11, 192.12

[56] References Cited

U.S. PATENT DOCUMENTS

| | | | |
|---|---|---|---|
| 3,435,193 | 3/1969 | Aitchison | 364/850 X |
| 3,497,717 | 2/1970 | Barber | 364/850 X |
| 3,824,002 | 7/1974 | Beard | 350/160 LC |
| 4,001,602 | 1/1977 | Birchenough | 364/850 X |
| 4,019,807 | 4/1977 | Boswell et al. | 350/160 LC |
| 4,124,278 | 11/1978 | Grinberg | 350/342 |
| 4,198,647 | 4/1980 | Grinberg et al. | 357/30 |
| 4,272,197 | 6/1981 | Knop | 364/850 X |
| 4,351,589 | 9/1982 | Chavel et al. | 350/342 |

FOREIGN PATENT DOCUMENTS

| | | | |
|---|---|---|---|
| 0602966 | 4/1978 | U.S.S.R. | 364/850 |
| 0604015 | 4/1978 | U.S.S.R. | 364/850 |
| 0742976 | 6/1980 | U.S.S.R. | 364/850 |

*Primary Examiner*—Gary V. Harkcom

*Attorney, Agent, or Firm*—V. D. Duraiswamy; V. G. Laslo; A. W. Karambelas

[57] ABSTRACT

Apparatus for performing a division of a dividend intensity array by a divisor intensity array on a pixel-by-pixel basis, to yield a quotient intensity array, wherein optical feedback principles are utilized in conjunction with two spatial radiation modulators, so that analog division is achieved. Specifically, a fraction of the output array of a first spatial radiation modulator is provided as the readout array to a second spatial radiation modulator, whose input is the divisor intensity array. The output array of the second image converter is then added to the dividend array and provided as the input to the first spatial radiation modulator, whereupon the output of the first spatial radiation modulator is the pixel-by-pixel quotient array resulting from division of the dividend array by the divisor array.

16 Claims, 7 Drawing Figures

| | |
|---|---|
| 0.63 | 1.0 |

÷

| |
|---|
| 1.0 |
| 0.25 |

=

| | |
|---|---|
| 0.63 | 1.0 |
| 2.5 | 4.0 |

| | |
|---|---|
| 0.63 | 1.0 |

÷

| |
|---|
| 1.0 |
| 0.25 |

=

| | |
|---|---|
| 0.67 | 1.0 |
| 2.67 | 4.1 |

NUMERICAL DIVISION OF TWO ARRAYS BY OPTICAL PROCESSING

BACKGROUND OF THE INVENTION

The U.S. Government has rights in this invention pursuant to Contract No. F49620-81-C-0056, awarded by the Department of the Air Force.

This invention relates to the processing of optical arrays, and, more particularly, to apparatus for performing a numerical division of two arrays.

Typical electronic computers of the conventional type function in a serial processing manner. Data retrieved from memory is processed through a central processing unit, with the results stored in memory. Thus, for example, if one million division operations are to be performed, the first dividend and divisor are retrieved from memory, the division operation is accomplished, and the quotient is stored in memory. The computer then repeats the operation for the second set of numbers, the third set of numbers, and so forth. The one million division operations therefore occupy the computer for a period of time approximately one million times as long as does a single division operation.

Certain processing operations may occur in parallel, as for example the operation of peripheral devices, but in general the speed of electronic computers is limited by the serial nature of the processing. Although some computers employ multiple central processors, so that some operations may truly proceed in parallel, the software management of multiple central processors is complex, and it is also not practical to include very large numbers of central processors in an electronic computer. Thus, there has been a continuing search for computer technology that would allow massive parallel processing of data, thereby increasing the speed of the computer.

One promising improvement to computer machinery that allows massive parallel procesing is the use of active and passive optical elements to form logic structures. Data is encoded onto a light beam, which is then processed through these optical elements. Each bit of data is encoded into a pixel, or very small cross sectional area, of the light beam, and all pixels of the light beam are processed at the same time through elements such as lenses, optical amplifiers, etc.

Certain basic logical and arithmetic functional computing elements are required for optical computers, just as they are required for electronic computers. Computers using optical elements must provide logical functions such as NOT, AND and OR, and must also include arithmetic operations such as add, subtract, multiply and divide. In addition, the computer using optical elements may optionally have specialized dedicated hardware elements built up from these logical and arithmetic functions.

The developing technology of optical computing elements now includes commercial or laboratory-scale hardware for performing the logical NOT, AND and OR functions, and also addition, subtraction and multiplication functions. In common with electronic computers, the division arithmetic operation presents greater difficulties. To date, there has been proposed no approach, either digitial or analog, for optically dividing an arbitrarily selected dividend by an arbitrarily selected divider, to yield a quotient. Similarly, there has been suggested no approach for simultaneously dividing an array of dividends by an array of divisors, to yield an array of quotients. Such a parallel numerical division operation is necessary for the construction of optical or hybrid electronic-optical computers, since the electronic hardware required for performing multiple parallel divisions becomes unreasonably extensive.

Accordingly, there exists an ongoing need for a hardware arithmetic division element whereby a first array of optically encoded intensity information may be divided on a pixel-by-pixel basis by a second array of optically encoded intensity information, in a numerical division operation, to produce a third array having the quotient of each of the divisions similarly encoded in an optical array. The present invention fulfills this need, and further provides related advantages.

SUMMARY OF THE INVENTION

The present invention provides an arithmetic computing element for performing a pixel-by-pixel division of two arrays of optically encoded information to produce a third or quotient array. With the use of this optical arithmetic element, massive arrays of data may be processed in parallel, thereby offering the potential for greatly reduced computing time, where multiple operations are to be performed. The optical arithmetic element of the present invention utilizes only two active components in conjunction with a number of passive elements, so that the complexity of the device is minimized, thereby assuring its reliability and easy maintainability. Moreover, both coherent and incoherent radiation may be readily processed.

In accordance with the invention, an apparatus for simultaneously performing division of a dividend intensity array by a divisor intensity array, on a pixel-by-pixel basis, to yield a quotient intensity array, comprises means for producing the quotient intensity array proportional to an additive intensity array on a pixel-by-pixel basis, and means for feeding back a fraction of the quotient intensity array to the means for producing, the fraction being proportional to the divisor intensity array on a pixel-by-pixel basis to yield a product intensity array, the means for feeding back including addition means for adding the product intensity array and the dividend intensity array on a pixel-by-pixel basis, to produce the additive intensity array. The product array should therefore be proportional to both the quotient array and the divisor array. Thus, the apparatus functions under the principles of optical feedback to achieve division.

In a presently preferred embodiment, the apparatus includes two active spatial radiation modulators, a beam splitter, and a beam combiner, together with other optional optical elements such as lenses. The spatial radiation modulators are preferably light valves, most preferably liquid crystal light valves of a type previously developed and known in the art, but used in different applications. In this preferred embodiment, a readout reference array and an input additive array are provided to a first spatial radiation modulator, and the output of this first spatial radiation modulator is a quotient array pixel-by-pixel proportional to the numerical quotient of the desired division function. The readout reference array is conveniently a constant intensity beam, while the input additive array is formed in a manner incorporating both dividend and divisor information, in a manner to be subsequently described. The second spatial radiation modulator is arranged so that its readout beam is a fractional quotient array and its input is the desired divisor array, with its output being a product array. The readout fractional quotient array of this second spatial radiation modulator is provided by the beam splitter positioned to receive the quotient array from the first spatial radiation modulator. The beam splitter, which may conveniently be a partially reflective mirror, passes a transmitted quotient array and splits out a fractional quotient array, with the fractional quotient array being directed to the second spatial radiation modulator as its readout fractional quotient array. That is, a fractional portion of the output array from the first spatial radiation modulator is provided as the readout array for the second spatial radiation modulator. The output product array of the second spatial radiation modulator is added to the dividend array to form an additive array in the beam combiner, and the additive array is then provided to the first spatial radiation modulator as its input additive array. The four named elements thus form a feedback loop which receives input in the form of two separate optical beams containing the dividend and divisor intensity arrays, and also receives a reference input beam, and then produces an output quotient array beam.

From the foregoing, it will be appreciated that the present invention represents an important development in the field of optical computing elements. Parallel division of massive arrays of data on a pixel-by-pixel basis may be performed utilizing relatively simple optical components. Other features and advantages of the present invention will become apparent from the following more detailed description, taken in conjunction with the accompanying drawings, which illustrate, by way of example, the principles of the invention.

DETAILED DESCRIPTION OF THE DRAWINGS

Figure 4:
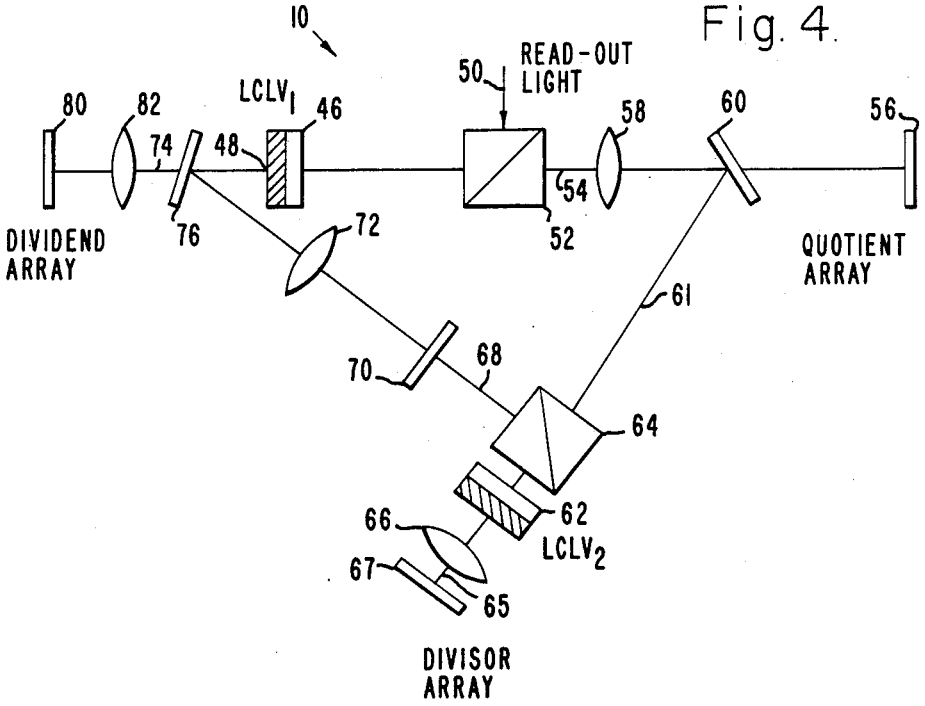
FIG. 4 is a block diagram of an apparatus for performing pixel-by-pixel division of two optical beams.
Figures 5, 6A, 6B:
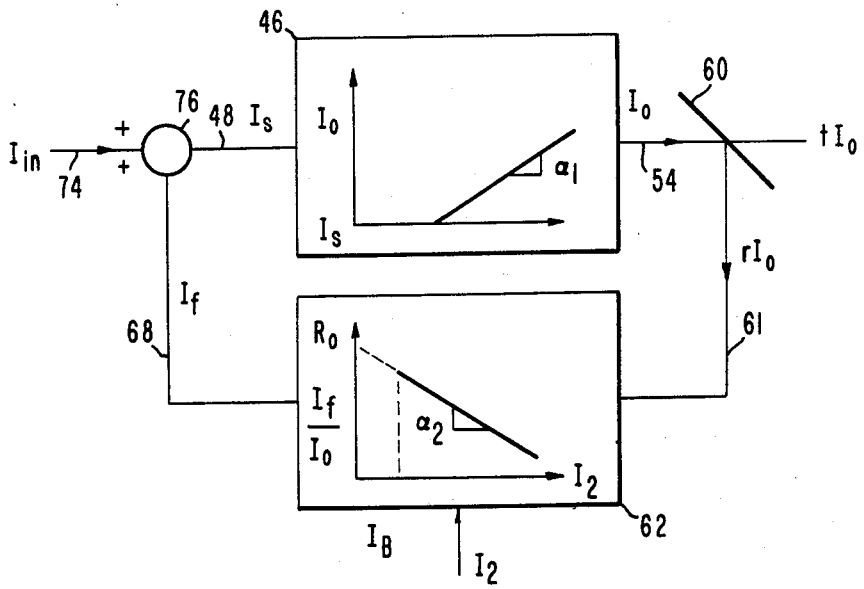
FIG. 5 is a schematic block diagram corresponding to the elements of FIG. 4, and indicating the performance of the liquid crystal light valves in a preferred embodiment.
FIG. 6*a* is a schematic chart illustrating the expected quotient array obtained from the numerical division of a dividend array by a divisor array.

FIG. 6*b* is a schematic chart illustrating the actual quotient array obtained from the numerical division of the dividend and divisor arrays of FIG. 6*a* using the apparatus of FIG. 4.

DETAILED DESCRIPTION OF THE PREFERRED EMBODIMENT

As is shown in the drawings with reference to a preferred embodiment of the invention, and particularly as shown in FIGS. 4 and 5, the present invention is concerned with an apparatus 10 for performing scalar division of two optical intensity arrays. In the illustrated embodiment, the apparatus utilizes two spatial radiation modulators, preferably liquid crystal light valves. These liquid crystal light valves are the only active optical elements of the apparatus 10, and their operation will first be described.

Figure 1:
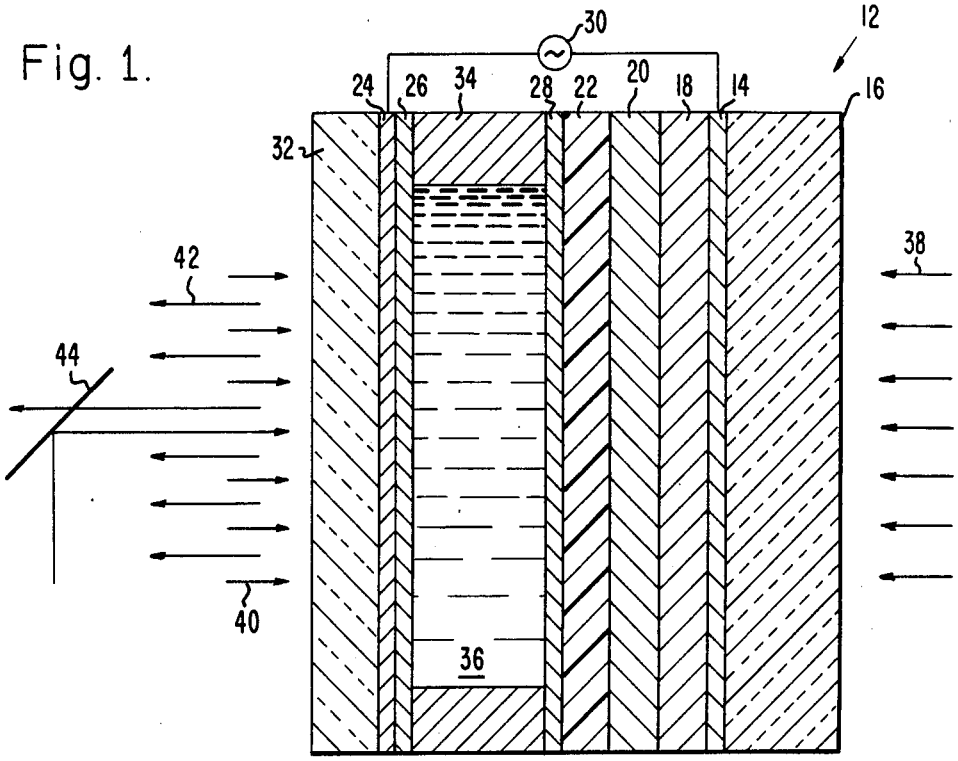
FIG. 1 is a schematic cross sectional diagram of a preferred liquid crystal light valve for use in the present invention.

The structure and operation of representative liquid crystal light valves are disclosed in U.S. Pat. Nos. 4,124,278, 4,198,647, 4,351,589, 4,019,807 and 3,824,002, for example, whose disclosures are herein incorporated by reference. A cross sectional schematic view of a liquid crystal light valve 12 suitable for use in the present invention is illustrated in FIG. 1. In preparing the liquid crystal light valve, a transparent conductive coating 14 of indium tin oxide is deposited on a glass or fiber optic substrate 16, which forms the input end of the light valve 12. Upon this base is reactively sputtered a CdS photosensitive film 18 of thickness 12–50 micrometers. Next, a two micron thick film 20 of CdTe, to block visible light, is deposited, followed by a broadband dielectric mirror 22 that consists of alternate high and low refractive index films of sputtered $TiO_2$ and $SiO_2$. The structure is completed with a transparent conductive counterelectrode 24 overlayed with an inert $SiO_2$ film 26, opposite a similar film 28 deposited on the mirror 22. The transparent conductive coating 14 and the counterelectrode 24 provide electrical contacts to an external AC voltage source 30. A glass plate 32 closes the opposite or output end of the liquid crystal light valve 12. An annular spacer 34 defines a cavity 36 which contains a liquid crystal material.

In operation of the liquid crystal light valve 12, an input beam 38 of light is directed against the substrate 16 at the input end of the liguid crystal light valve 12. A readout beam 40 of light is directed against the oppositely disposed glass plate 32 at the output end of the liquid crystal light valve 12. An output beam 42 of light is emitted outwardly from the light valve 12 through the glass plate 32. The readout beam 40 and the output beam 42 may both be directed normal to the surface of the glass plate 32 through the use of a partially silvered mirror 44 positioned above the glass plate 32. As will be described subsequently, of importance to the present invention is the characteristic, controllable relationship between the spatial intensity array of the input beam 38 and the spatial intensity array of the output beam 42, whose relationship is controllable through variation of the voltage imposed by the voltage source 30.

In operation, the CdS photosensitive film 18 serves as a photoconductor and photocapacitor to act as a high resolution light controlled voltage gate for the liquid crystal layer in the cavity 36, responsive to input beam 38. The dielectric mirror 22 serves to reflect the readout beam 40, and the CdTe light blocking film 20 prevents residual light from the readout beam 40 from reaching the photosensitive film 18. Because of the high DC sensitivity of the dielectric mirror 22, the device is operated with an AC voltage impressed across the sandwich structure by the voltage source 30. This approach has the added benefit of extending the operating lifetime of the liquid crystal. Typically, the applied voltage varies from about two to about 50 volts, depending primarily upon the voltage threshold of the liquid crystal.

Figure 2:
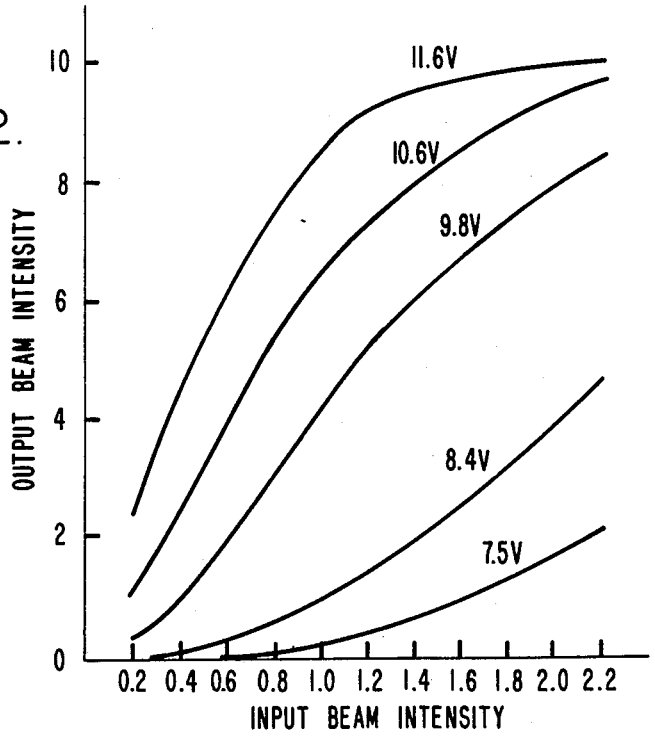
FIG. 2 is a graph illustrating the positive slope operating mode of a liquid crystal light valve.
Figure 3:
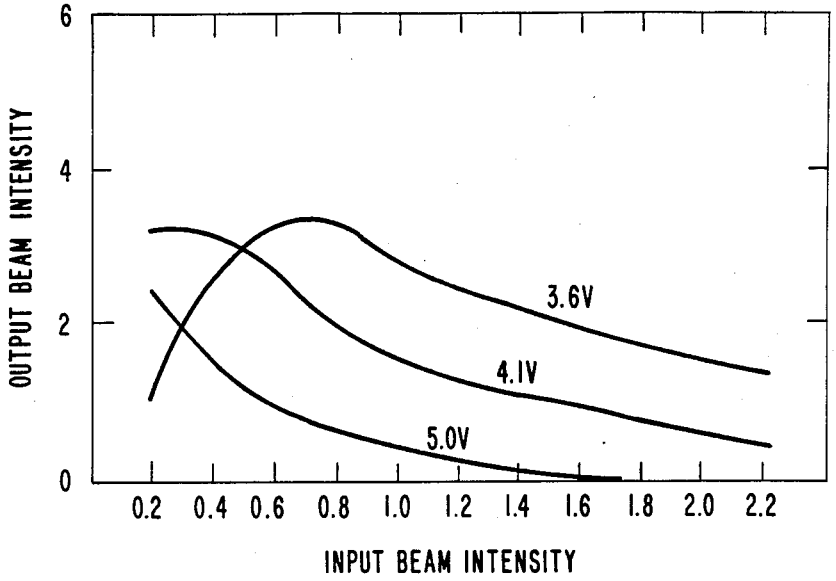
FIG. 3 is a graph illustrating the negative slope operating mode of a liquid crystal light valve.

FIGS. 2 and 3 illustrate typical relationships between the intensities of the input beam 38 and the output beam 42, for various voltages supplied by the voltage source 30. The operating performance of different liquid crystal light valves may vary due to a variety of factors. It is preferred that the curves of FIGS. 2 and 3 be measured for each liquid crystal light valve before use.

For the voltages illustrated in FIG. 2, the output beam intensity increases with increasing input beam intensity, for all values. Operation of the liquid crystal light valve 12 in this voltage regime is known as operation in the positive slope mode. Over certain ranges of input beam intensities and for certain voltages, the output beam intensity may be essentially linearly dependent upon the input beam intensity. For example, over relative input beam intensities of from about 0.4 to about 1.0, and for applied voltages of from about 9 to about 11 volts, the results illustrated in FIG. 2 exhibit a nearly linear, positively sloped dependence of the output beam intensity on the input beam intensity. In operation of the light valve 12, each pixel of the input beam 38 would be linearly amplified in the output beam 42, when the light valve 12 is operated in this linear positive slope mode.

As illustrated in FIG. 3, the light valve 12 may also exhibit a negatively sloped dependence of the output beam intensity on the input beam intensity. For voltages of from about 2 to about 5 volts, the light valve 12 exhibits a linearly decreasing output beam intensity with increasing input beam intensity, for input beam intensity ranges indicated in FIG. 3. Operation in this regime is termed the negative slope operating mode, and the output is said to be inversely proportional to input. The negative slope operating mode may be achieved by other techniques, as through the use of a quarter wave plate and external polarizers, in conjunction with other spatial radiation modulators or liquid crystal light valves operating in the positive slope mode, as disclosed in U.S. Pat. No. 4,019,807.

In relation to the present invention, a beam of light may be considered as an array of analog information. The information may be, for example, a visual scene such as a photograph of the earth, or it may be encoded data which does not have any apparent visual meaning. The amount of data incorporated in the array can also vary by making the array physically larger or smaller or by varying the pixel size. The array can also have only one element. As used herein, a beam is an array of elements. The array intensity is thus the local beam intensity.

The local intensity of the light beam at any point, or pixel, conveys isolated information or information concerning the relationship of that pixel to the other pixels making up the entire array or beam. With the apparatus of the present invention, all pixels of an array may be simultaneously and similarly processed by the described optical elements. The present invention allows each pixel of a dividend array or light beam to be divided, in a scalar or numerical sense, by the spatially corresponding pixel of a divisor array or light beam. Since all pixels of each beam are similarly processed, the result is that the entire dividend array is divided by the entire divisor array, on a pixel-by-pixel basis, to yield a quotient array.

In accordance with a particularly preferred embodiment of the invention, illustrated in FIG. 4, a first spatial radiation modulator, preferably a first liquid crystal light valve 46, receives an input additive array, represented by the numeral 48, whose exact makeup is to be defined subsequently. (In FIG. 4, an array is indicated by a numeral and lead line to the beam path traversed by the optical beam or array. In most instances, a lens focuses the beam on an element, and the array is out of focus elsewhere. For ease of representation, the array or beam is denominated and called out by reference to its beam path.) The first liquid crystal light valve readout beam 50 is preferably a beam of constant intensity, which may be either coherent or incoherent light, directed normally to the surface of the first liquid crystal light valve 46 by a polarizing beam splitter 52. The local intensity of the readout beam 50 may, however, be varied to tailor the readout beam 50 to peculiarities of the apparatus 10, such as, for example, a flawed mirror. The first liquid crystal light valve 46 is preferably operated in the positive slope mode, as illustrated in the idealized schematic block diagram of FIG. 5. The output beam array intensity is therefore linearly proportional to the input additive beam array intensity on a pixel-by-pixel basis.

The output beam 54 represents the desired quotient array. The output beam 54 is focused onto an output screen 56 by a lens 58. A fraction of the output beam 54 is split out of the beam prior to its reaching the output screen 56 by a beam splitter positioned to receive the output or quotient beam 54. The beam splitter is preferably a partially reflective mirror 60. The partially reflective mirror 60 directs a fraction 61 of the quotient beam 54 toward the output side of a second liquid crystal light valve 62, through a dielectric beam splitter 64 which allows the fractional light beam 61 to be utilized as the readout array or beam for the second liquid crystal light valve 62. That is, the readout beam for the second light crystal light valve 62 is not a constant intensity beam, as is preferably the case for the first liquid crystal light valve 46, but instead varies in proportion to the quotient array on a pixel-by-pixel basis.

The input array for the second liquid crystal light valve 62 is the divisor array 65, which is to be divided into the dividend array. The divisor array is provided from a source 67 and is focused onto the input face of the second liquid crystal light valve 62 by a lens 66. The second liquid crystal light valve 62 is operated in the negative slope mode, so that the output beam is inversely proportional to the input beam.

The output beam of the second liquid crystal light valve 62, herein termed a product array 68, is optionally reduced in intensity by an attenuator 70, and then focused by a lens 72. The processed product array 68 is then added to a dividend array 74 by a beam combiner, which may conveniently be a dielectric coated mirror 76, to form the additive array 48, which is then directed against the input side of the first liquid crystal light valve 46. The dividend array 74 is provided from a source 80 and focused by a lens 82. When so composed, the input additive array 48 causes the output of the first liquid crystal light valve 46, the quotient array 54, to be proportional to the quotient of the division of the dividend array 74 by the divisor array 65, on a pixel-by-pixel basis, accomplishing the desired result.

The results of one test of the apparatus 10 are illustrated in FIG. 6. An input dividend array 74 was two vertical bars having regions of relative intensity 1.0 and 0.63. The divisor array 65 was two horizontal bars having regions of relative intensity of 1.0 and 0.25. FIG. 6*a* illustrates the expected quotient array obtained from the numerical division of the dividend array by the divisor array. The readout array 50 and the dividend array 74 were beams of monochromatic light provided by an argon laser having a wavelength of 5440 Angstroms. The light for the divisor array 65 was provided by an incandescent microscope light source 67. It is emphasized that the operation of the present apparatus 10 is not limited to particular combinations of coherent and incoherent light sources, or to light sources having particular fixed or variable wavelengths. Instead, the apparatus 10 is operable for all combinations of such light sources. The use of the argon laser merely provided a convenient approach to controlling intensity level and optimizing output of the liquid crystal light valves, and allowed convenient measurements to be taken.

FIG. 6*b* illustrates the actual quotient array obtained by the apparatus 10. The actual quotient results were, on the average, about five percent higher than the expected quotient results, with a standard deviation of about two percent. It is believed that further advances in the optimization of liquid crystal light valves will result in improved accuracy of the results of the division of the arrays.

The operation of the apparatus 10 is achieved and governed by the principles of optical feedback as applied to devices such as the liquid crystal light valves 46 and 62. The following analysis is expressed in terms of the operating performance parameters of the liquid crystal light valves 46 and 62 of the preferred embodiment, although the operation and scope of the invention are not so limited.

Referring to FIG. 5, the operating characteristic of the first liquid crystal light valve 46, operating in the positive slope linear mode, may be expressed as:

$$I_o=\alpha_1 I_{RO}(I_S-I_A) \quad (1)$$

where $I_o$ is the pixel-by-pixel intensity of the quotient array 54, $\alpha_1$, is the slope of the output curve of the light valve 46 and $I_A$ is the horizontal axis intercept, $I_{RO}$ is the intensity of the readout beam 50, and $I_S$ is the intensity of the additive array 48.

The operation of the second liquid crystal light valve 62, operating in the preferred negative slope linear mode, may be expressed as:

$$I_F=rI_o[R_o-\alpha_2(I_2-I_B)] \quad (2)$$

where $I_F$ is the intensity of the product array 68 on a pixel-by-pixel basis, $I_2$ is the intensity of the corresponding pixel in the divisor array 65, r is the net fraction of the quotient array 54 which is included in the additive array 48, $R_o$ is the intercept of the negatively sloped output curve of the second liquid crystal light valve 62, $\alpha_2$ is the slope of the output curve, and $I_B$ is the input intensity at the beginning of the linear region. The positive bias $R_o$ allows negative numbers to be readily processed using the apparatus 10.

The intensity $I_s$ of the additive array 48 is given by:

$$I_s=I_{in}+I_f \quad (3)$$

where $I_{in}$ is the intensity of the dividend array 74.

When equations 1–3 are solved for the intensity of the quotient array 54, the following results:

$$I_o=\frac{I_{RO}\alpha_1(I_{in}-I_A)}{1-r\alpha_1 I_{RO}(R_o+\alpha_2 I_B)+r\alpha_1 I_{RO} I_2\alpha_2} \quad (4)$$

This equation may be simplified by satisfying the following critical condition, which is device dependent and not function dependent:

$$1=r\alpha_1 I_{RO}(R_o+\alpha_2 I_B) \quad (5)$$

so that equation 4 becomes:

$$I_o=\frac{I_{in}-I_A}{r\alpha_2 I_2} \quad (6)$$

Equation 6 expresses the desired result, wherein the quotient array is proportional to the ratio between the dividend array 74 and the divisor array, after adding back a constant value. The critical condition, equation 5, may be readily obtained by a determination of the operating characteristics of the two liquid crystal light valves 46 and 62 and the reflectivities of the various reflecting elements, and then making adjustments to the intensity of the readout beam 50. Any other approach for satisfying the condition of equation 5 is also acceptable.

The apparatus 10 may also be operated without satisfying equation 5, although the performance is less accurate than that achieved when equation 5 is satisfied. In general, the output of an optical feedback device is governed by the following equation:

$$Q=\frac{DA}{1+AB} \quad (7)$$

where Q is the output, D is the input corresponding to the dividend, A is a system constant, and B is the operating characteristic of the feedback branch. In the regime where the product AB is much greater than 1, equation 7 becomes:

$$Q=D/B \quad (8)$$

If the operating characteristic B of the feedback branch is made inversely proportional to the divisor in feedback, then the output Q is proportional to the dividend divided by the divisor, the desired result.

The characteristic B may be made inversely proportional to the divisor by operating the second liquid crystal light valve 62 in the negative slope mode. However, it is difficult with presently available optical components to satisfy the condition AB much greater than one, and therefore operation of the apparatus 10 in this mode produces only an approximation of the proper quotient. It is expected that improvements in liquid crystal light valves or other sorts of spatial radiation modulators, and improvements in other optical components, may allow this operating mode to be used more readily in future devices.

It will now be appreciated that, through the use of this invention, two optical arrays may be divided one by the other, on a pixel-by-pixel basis, to produce a quotient array. This development allows the parallel processing of massive amounts of information, which may be encoded onto light beams. With the development of the apparatus for performing scalar division of arrays, it is now possible to build computers utilizing optical elements to perform all logic and numerical functions that may be performed by conventional electronic computers. Another important application of the present invention is the processing of light having visual meaning, such as in dividing one photographic image by another on a pixel-by-pixel basis. The apparatus of the present invention may be utilized to process visible light or other radiation. Although a particular embodiment of the invention has been described in detail for purposes of illustration, various modifications may be made without departing from the spirit and scope of the invention. Accordingly, the invention is not to be limited except as by the appended claims.

What is claimed is:

1. Apparatus for simultaneously performing division of a dividend intensity array by a divisor intensity array on a pixel-by-pixel basis, to yield a quotient intensity array, comprising:

means for producing as output the quotient intensity array proportional to an input additive intensity array on a pixel-by-pixel basis; and means for feeding back a fraction of the output quotient intensity array to said means for producing the quotient intensity array, said fraction being proportional to the divisor intensity array on a pixel-by-pixel basis, said means for feeding back including modulator means for modulating the fractional quotient intensity array with the divisor intensity array to produce a product intensity array and addition means for adding the product intensity array and the dividend intensity array on a pixel-by-pixel basis, to produce the additive intensity array, whereby said means for producing the quotient intensity array, produces an output which is proportional to the quotient of the division of the dividend intensity array by the divisor intensity array.

2. The apparatus of claim 1 wherein said means for producing the quotient intensity array includes a first spatial radiation modulator operating in a positive slope mode.

3. The apparatus of claim 1 wherein said means for feeding back includes:

splitter means for splitting a fractional quotient intensity array from the quotient array.

4. The apparatus of claim 1 wherein said means for feeding back includes a second spatial radiation modulator operating in a negative slope mode.

5. The apparatus of claim 1 wherein said means for feeding back includes a liquid crystal light valve operating in a negative slope mode.

6. The apparatus of claim 1 wherein at least one of the reference intensity array, the dividend intensity array, and the divisor intensity array is incoherent radiation.

7. The apparatus of claim 1 wherein at least one of the reference intensity array, the dividend intensity array, and the divisor intensity array is visible light.

8. Apparatus for simultaneously performing an analog division of a dividend intensity array by a divisor array on a pixel-by-pixel basis, to yield a quotient array, comprising:

a first spatial radiation modulator having a readout reference array and an input additive array, the output of said first spatial radiation modulator being the quotient array;

a second spatial radiation modulator having a readout fractional quotient array and the input divisor array, the output of said second spatial radiation modulator being a product array;

a beam splitter positioned to receive the quotient array, said beam splitter passing a transmitted quotient array and splitting out a fractional quotient array, the fractional quotient array being provided to said second spatial radiation modulator as the readout fractional quotient array; and a beam combiner positioned to add the product array and the dividend array together to form an additive array, the additive array being then provided to said first spatial radiation modulator as the input additive array.

9. The apparatus of claim 8 wherein said first and second spatial radiation modulators are liquid crystal light valves.

10. The apparatus of claim 8 wherein said beam splitter and said beam combiner include partially reflective mirrors.

11. The apparatus of claim 8 further including a spatial radiation modulator beam splitter positioned directly above each spatial radiation modulator and oriented to direct a beam of radiation perpendicularly against the output face of the respective spatial radiation modulator, whereby the readout array may be input normal to the output surface of the respective spatial radiation modulator, and the output array may be extracted normal to the surface of the respective spatial radiation modulator.

12. The apparatus of claim 8 wherein each of said arrays is visible light.

13. The apparatus of claim 8 wherein each of said arrays is incoherent radiation.

14. The apparatus of claim 8 further including at least one lens to focus an array.

15. The apparatus of claim 8 further including an attenuator positioned so as to receive the product array output of said second spatial radiation modulator and attenuate said product array before it is applied as input to said beam combiner.

16. Apparatus for performing optical division of a dividend beam by a divisor beam on a pixel-by-pixel basis using optical feedback to produce a quotient beam, comprising:

first spatial radiation modulation means, acting upon a readout reference beam and an input additive beam, for producing said quotient beam as output in response to said input additive beam;

second spatial radiation modulation means, acting upon a readout fractional quotient beam and the input divisor beam, for producing a product beam as output, and addition means for producing said input additive beam by adding the dividend beam and said product beam on a pixel-by-pixel basis, so that said quotient beam produced in response to said input additive beam is the pixel-by-pixel quotient beam resulting from the division of the dividend beam by the divisor beam.

* * * * *